US012018600B2

(12) United States Patent
Vaidya et al.

(10) Patent No.: US 12,018,600 B2
(45) Date of Patent: Jun. 25, 2024

(54) SYNCHRONIZATION OF LUBRICANT SYSTEM SERVICE

(71) Applicant: CUMMINS FILTRATION IP, INC., Columbus, IN (US)

(72) Inventors: Abhijeet Vaidya, Columbus, IN (US); Bharadwaj R. Prabhala, Columbus, IN (US); Erica Christine Clark-Heinrich, Cookeville, TN (US); Abhijit Shimpi, Hermitage, TN (US)

(73) Assignee: CUMMINS FILTRATION IP, INC., Columbus, IN (US)

( * ) Notice: Subject to any disclaimer, the term of this patent is extended or adjusted under 35 U.S.C. 154(b) by 1325 days.

(21) Appl. No.: 16/491,420

(22) PCT Filed: Mar. 7, 2018

(86) PCT No.: PCT/US2018/021346
§ 371 (c)(1),
(2) Date: Sep. 5, 2019

(87) PCT Pub. No.: WO2018/165302
PCT Pub. Date: Sep. 13, 2018

(65) Prior Publication Data

US 2020/0018200 A1 Jan. 16, 2020

Related U.S. Application Data

(60) Provisional application No. 62/468,788, filed on Mar. 8, 2017.

(51) Int. Cl.

| | |
|---|---|
| ***F01M 11/10*** | (2006.01) |
| ***F01M 1/10*** | (2006.01) |
| ***F01M 1/18*** | (2006.01) |

(52) U.S. Cl.
CPC ..... *F01M 11/10* (2013.01); *F01M 1/10* (2013.01); *F01M 1/18* (2013.01);
(Continued)

(58) Field of Classification Search
None
See application file for complete search history.

(56) References Cited

U.S. PATENT DOCUMENTS 4,733,556 A 3/1988 Meitzler et al.
5,968,371 A 10/1999 Verdegan et al.
(Continued)

FOREIGN PATENT DOCUMENTS

CN 1709551 A 12/2005
CN 1807850 A * 7/2006 ..... F01M 11/12
(Continued)

OTHER PUBLICATIONS

First Office Action issued for Chinese Patent Application No. CN 201880015698.0, dated Nov. 11, 2020, 11 pages.
(Continued)

*Primary Examiner* — Amelia Vorce
(74) *Attorney, Agent, or Firm* — Foley & Lardner LLP

(57) ABSTRACT

A fluid delivery system for an internal combustion engine and a method of monitoring the fluid delivery system are described. The systems and methods monitor and determine various fluid quality parameters and filter element pressure drop, which can be used to determine real-time estimates of remaining useful life for both the filter element and the fluid. The respective remaining useful life calculations are used by the described systems and methods to determine change intervals for the fluid and the filter element. The change intervals can be synchronized by the systems and methods to reduce the amount of down time due to servicing of the fluid delivery system.

25 Claims, 8 Drawing Sheets

(52) U.S. Cl.
CPC ..... *F01M 2001/1007* (2013.01); *F01M 2011/1413* (2013.01); *F01M 2011/1446* (2013.01); *F01M 2011/148* (2013.01); *F01M 2250/60* (2013.01)

(56) References Cited

U.S. PATENT DOCUMENTS

| | | | | |
|---|---|---|---|---|
| 7,922,914 | B1 * | 4/2011 | Verdegan | B01D 37/046 702/50 |
| 2004/0107055 | A1 | 6/2004 | Kolosov et al. | |
| 2011/0307160 | A1 * | 12/2011 | Verdegan | B01D 37/046 702/34 |
| 2013/0183138 | A1 * | 7/2013 | Johnson | F03D 80/70 415/110 |
| 2015/0047419 | A1 * | 2/2015 | Cao | F01M 11/10 73/53.07 |
| 2015/0082871 | A1 | 3/2015 | Zha | |
| 2015/0338386 | A1 | 11/2015 | Chapman, III | |
| 2015/0361840 | A1 * | 12/2015 | Verdegan | B01D 35/143 702/34 |
| 2016/0025265 | A1 | 1/2016 | Smith et al. | |
| 2017/0101911 | A1 * | 4/2017 | Barnes | F01M 11/04 |
| 2017/0102308 | A1 * | 4/2017 | Gillette, II | G01N 11/00 |
| 2018/0238433 | A1 * | 8/2018 | Syrowik | G01N 33/2888 |

FOREIGN PATENT DOCUMENTS

| | | | | | |
|---|---|---|---|---|---|
| CN | 102287248 | A | | 12/2011 | |
| CN | 204098996 | U | | 9/2014 | |
| CN | 204253124 | U | | 4/2015 | |
| CN | 105065085 | A | * | 11/2015 | F01M 11/10 |
| CN | 204921085 | U | | 12/2015 | |
| CN | 105804829 | A | * | 7/2016 | B01D 35/143 |
| CN | 103983758 | | | 8/2016 | |
| DE | 102014015396 | A1 | * | 4/2016 | F01M 11/03 |
| KR | 20070109643 | A | * | 11/2017 | G01F 23/24 |

OTHER PUBLICATIONS

International Search Report and Written Opinion issued for PCT/US2018/021346, dated May 17, 2018, 15 pages.

* cited by examiner

SYNCHRONIZATION OF LUBRICANT SYSTEM SERVICE

CROSS REFERENCE TO RELATED APPLICATIONS

The present application is a national stage of PCT Application No. PCT/US2018/021346, filed Mar. 7, 2018 which claims priority to U.S. Provisional Patent Application No. 62/468,788, filed Mar. 8, 2017 and entitled "Synchronization of Lubricant System Service." The contents of both applications are incorporated herein by reference in their entirety and for all purposes.

TECHNICAL FIELD

The present application relates to lubrication systems and to lubricant condition monitoring of internal combustion engines.

BACKGROUND

Internal combustion engines operating on various fuels such as diesel, gasoline, ethanol, natural gas, etc., include one or more piston/cylinders pairs which reciprocate to produce rotary motion which is utilized for performing mechanical work. The internal combustion engines generally include a lubrication system that circulates lubricant (e.g., oil, synthetic oil, etc.) to the moving parts of the internal combustion engine (e.g., the pistons moving within the cylinders). During operation of the internal combustion engine, the lubricant is heated and thermally breaks down and absorbs byproducts of combustion, debris, and water. As operation of the internal combustion engine continues over time, the lubricant becomes less effective and negatively impacts the performance of the engine. Old, contaminated and decomposed lubricant can severely impact engine performance and efficiency as well as lead to increased emissions. Accordingly, the lubricant must be replaced from time to time to avoid damage to the engine.

Additionally, the lubrication system typically includes a lubricant filtration system. The filtration system includes a filter element that filters the lubricant as the lubricant is circulated through the lubrication system. The filter element includes filter media that captures and removes contaminants (e.g., dirt, debris, etc.) from the lubricant. As the filter media captures the contaminants, the restriction across the filter element increases. Accordingly, the filter element requires periodic replacement as the filter media captures and removes the contaminants from the fluids passing through the filter media.

SUMMARY

One example embodiment relates to a fluid delivery system. The fluid delivery system includes a filtration system comprising a filter element. The fluid delivery system further includes a pressure sensing assembly configured to output a pressure signal indicating a pressure drop across the filter element, a viscosity sensor configured to output a viscosity feedback signal indicating a viscosity of a fluid, and a dielectric sensor configured to output a dielectric feedback signal indicating a dielectric constant of the fluid. The fluid delivery system includes a controller comprising a sensor input circuit and a service interval circuit, the sensor input circuit configured to receive the pressure signal, the viscosity feedback signal, and the dielectric feedback signal, the service interval circuit configured to dynamically determine when the filter element should be replaced based at least in part on the pressure differential feedback signal and when fluid should be replaced based at least in part on the viscosity feedback signal and the dielectric feedback signal.

Another example embodiment relates to a method. The method includes collecting, by a sensor input circuit of a controller, a viscosity feedback signal from a viscosity sensor indicating a viscosity of a fluid and a dielectric feedback signal from a dielectric sensor indicating a dielectric constant of the fluid for a time interval. The method further includes collecting, by the sensor input circuit of the controller, a pressure signal from a pressure sensing assembly indicating a pressure differential across a filter element of a fluid delivery system. The method includes determining, by a service interval circuit of the controller, that at least one of the fluid or the filter element require replacement based at least in part on the dielectric constant, the viscosity, or the pressure differential. The method further includes initiating, by the controller, a service alert to an operator device in response to determining that at least one of the fluid or the filter element require replacement.

Still another example embodiment relates to a controller for a fluid delivery system. The controller comprises a memory, a processor configured to execute instructions stored in the memory, and a sensor input circuit, a service interval circuit and an operator input/output circuit. The sensor input circuit is configured to receive a pressure signal indicating a pressure drop across a filter element, a viscosity feedback signal indicating a viscosity index of a fluid, and a dielectric feedback signal indicating a dielectric constant of the fluid. The service interval circuit is configured to dynamically determine when the filter element should be replaced based at least in part on the pressure signal and when fluid should be replaced based at least in part on the viscosity feedback signal and the dielectric feedback signal. The operator input/output circuit is configured indicate to a user that at least one of the filter element and the fluid has to be changed in response to the service interval circuit determining that at least one of the filter element and the fluid has to be changed.

These and other features, together with the organization and manner of operation thereof, will become apparent from the following detailed description when taken in conjunction with the accompanying drawings, wherein like elements have like numerals throughout the several drawings described below.

DETAILED DESCRIPTION

Figure 1:
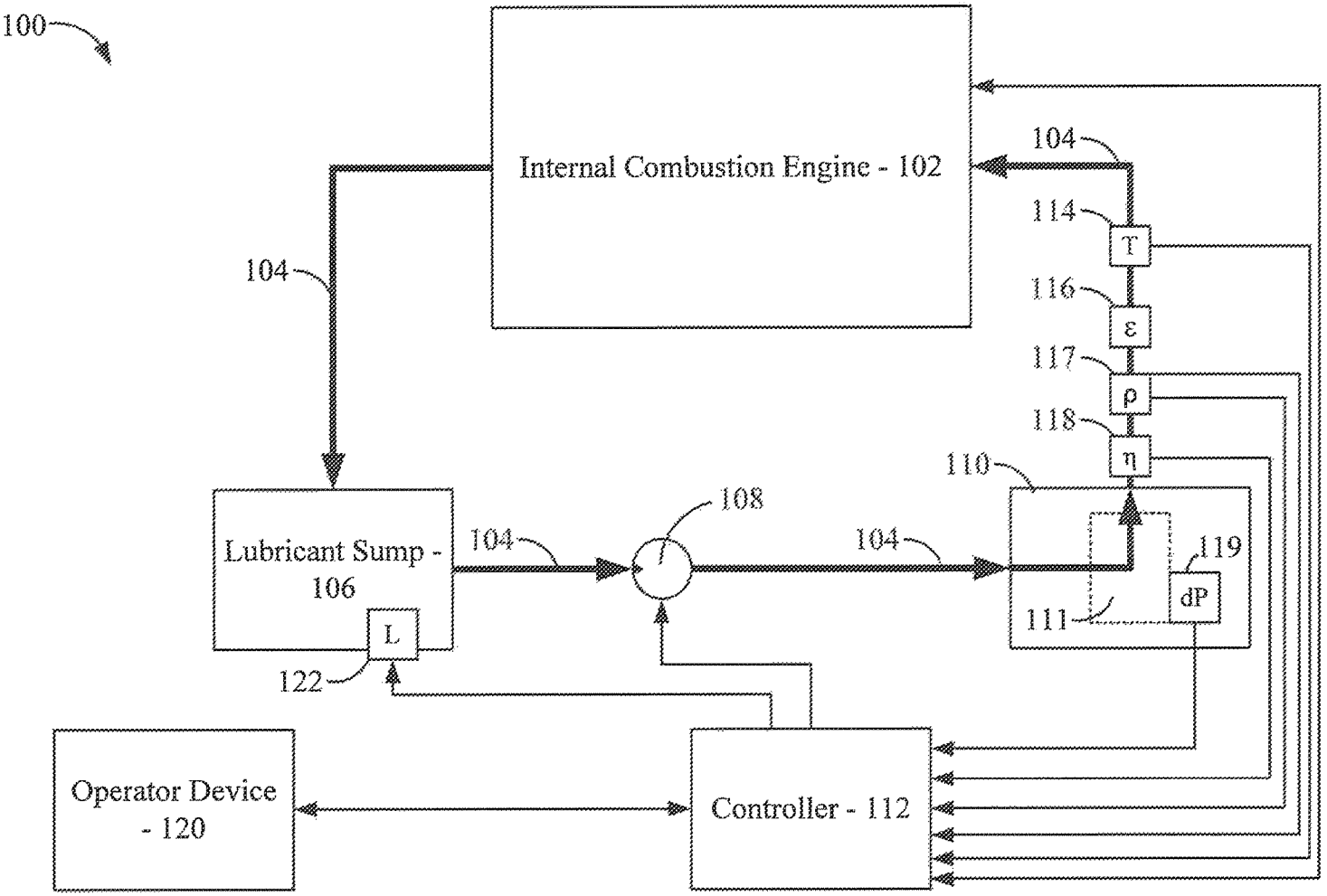
FIG. 1 shows a schematic view of a lubrication system of an internal combustion engine according to an example embodiment.

Referring to the figures generally, a fluid delivery system for an internal combustion engine and a method of monitoring the fluid delivery system are described. In particular embodiments, the fluid delivery system comprises a lubrication system. While various embodiments described in this specification refer to a lubrication system, it should be understood that the fluid delivery system may include other fluid delivery systems such as, for example, coolant delivery systems (e.g., for delivering and circulating a coolant such as those used in electrified systems, motors, or batteries), fuel delivery systems, fluid power systems (e.g., hydraulic drive systems) or water circulation systems. All such fluid delivery systems should therefore be considered to be within the scope of this disclosure.

The fluid delivery system (e.g., a lubrication system) generally circulates the fluid (e.g., a lubricant) from a sump (i.e., a reservoir), through a filtration system, to the internal combustion engine, and back to the sump. The fluid delivery system (e.g., a lubrication system) includes a filtration system having a replaceable filter element that filters the fluid (e.g., a lubricant) circulating in the fluid delivery system. The fluid delivery system includes a controller that monitors a dielectric constant of the fluid and a viscosity of the fluid. Based on the dielectric constant, the controller can determine whether the fluid flowing through the fluid system is a new fluid (e.g., recently replaced fluid) or old fluid (e.g., fluid that has degraded enough to be distinguished from new fluid). If old fluid is identified, the viscosity of the fluid is compared against threshold viscosities to dynamically determine when the fluid requires replacement. Further, the controller can determine a remaining useful life of the fluid in the fluid delivery system. Additionally, the controller monitors a pressure drop across the filter element of the filtration system to determine a remaining useful life of the filter element before replacement is required. Based on the status of the fluid and the remaining useful life of the filter element, the controller can synchronize service alerts such that a fluid change and a filter element change can occur during the same service event, which reduces the downtime of the internal combustion engine (and any machinery powered by the internal combustion engine).

As used herein, the "useful life" of a consumable (e.g., a filter element, fluid such as lubricant, etc.) refers to the expected amount of usability or "life" of the consumable before it needs to be replaced. The useful life may be an absolute measure of time (e.g., hours, days, weeks, etc.) after the consumable has been installed in or on an internal combustion engine, a measure of internal combustion engine run time after the consumable has been installed in or on the internal combustion engine (e.g., a number of hours the internal combustion engine has been operating with the consumable), a measure of distance that a vehicle powered by an internal combustion engine travels (e.g., a number of miles), a consumable specific measure (e.g., amount of fluid filtered through a filter element, amount of pressure drop across a filter element, amount of chemical breakdown of a fluid, etc.), or a combination thereof. As used herein, the "remaining useful life" of a consumable can refer to a fraction or percentage of the amount of the useful life of the consumable that is determined based on how much of the useful life remains after the consumable has been used for a certain period of time. The "remaining useful life" can also refer to an absolute number (e.g., time, distance, etc.) remaining relative to the overall useful life of the consumable.

Referring to FIG. 1, a lubrication system 100 for an internal combustion engine 102 is shown according to an example embodiment. Generally, the lubrication system 100 circulates lubricant (e.g., oil) to the moving parts of the internal combustion engine 102. The internal combustion engine 102 may be, for example, a diesel internal combustion engine, a gasoline internal combustion engine, a natural gas internal combustion engine, a turbine-powered engine, a biodiesel-powered engine, an ethanol engine, a liquid petroleum gas ("LPG") engine, prime movers, or the like. In some arrangements, the lubrication system 100 provides lubricant to other components (e.g., other components of a vehicle), such as a turbocharger, a compressor, a hydraulic system, a transmission, fuel cells, or the like.

The lubrication system 100 includes a number of conduits 104, a lubricant sump 106, a pump 108, and a filtration system 110. The conduits 104 facilitate the circulation of lubricant through the lubrication system 100. The lubricant sump 106 is a storage reservoir where lubricant is stored. The pump 108 draws the lubricant from the lubricant sump 106 and routes the lubricant through the filtration system 110, to the internal combustion engine 102, and back to the lubricant sump 106 via the conduits 104. The lubricant sump 106 is a storage reservoir (e.g., a tank) that stores lubricant not being circulated through the lubrication system 100. The filtration system 110 includes a filter element 111. The filter element 111 includes filter media (e.g., fibrous filter media, paper filter media, nano-fiber filter media, and/or the like). The filter media is structured to capture and remove contaminants (e.g., water, dust, debris, etc.) from the lubricant upstream of the internal combustion engine 102 in a lubricant flow direction. The filter element 111 requires periodic replacement as the filter media captures the contaminants.

The operation of the pump 108 is controlled by a controller 112. In some arrangements, the controller 112 comprises an engine control unit that also controls the operation of the internal combustion engine 102. In other arrangements, the controller 112 is configured to receive feedback relating to engine operating parameters from a separate engine control unit ("ECU") associated with the internal combustion engine 102 (e.g., via a J1939 vehicle bus data link). As such, the controller 112 receives various engine operating parameters, such as engine duty cycle, engine fuel information, engine odometer, engine rifle temperature, engine speed, exhaust parameters, turbocharger parameters, and the like.

As described in further detail below with respect to FIGS. 2 and 3, the controller 112 is structured to monitor the lubricant circulating in the lubrication system through at least a temperature sensor 114, a dielectric sensor 116, and a viscosity sensor 118. In some arrangements, the lubrication system may also include a density sensor 117. In some arrangements, each of the described sensors is in contact with the lubricant circulating in the lubrication system 100. In some arrangements, the dielectric sensor 116 and the viscosity sensor 118 are combined into a single sensor (e.g., into a single sensor housing). In further arrangements, a single sensor is structured to function as the temperature sensor 114, the dielectric sensor 116, the viscosity sensor 118, and/or the density sensor 117 (e.g., integrated into a single sensor housing). The temperature sensor 114, the dielectric sensor 116, and the viscosity sensor 118 are placed downstream in a lubricant flow direction of the filtration system 110 and upstream of the internal combustion engine 102, thereby ensuring that the lubricant flowing past each of the sensors is clean and is flowing (i.e., is not pooling as occurs in the lubricant sump 106). The controller 112 may monitor the lubricant to determine: (1) when new lubricant has been received in the lubrication system 100, (2) what the viscosity grade or viscosity index of the lubricant is, (3) a dynamic determination of when the lubricant should be replaced (i.e., an oil drain interval), and/or (4) whether a correct fluid has been added into the lubrication system 100 (e.g., added into the lubricant sump 106). In some arrangements, the controller 112 monitors the lubricant to determine at least one lubricant quality parameter. The at least one lubricant quality parameter may include any of lubricant type, kinematic viscosity, oxidation, TAN, TBN, the presence of wear metals (e.g., Fe) or a wear metal index, iron content, oxidation or nitration rates or any other lubricant quality parameter.

The controller 112 is structured to monitor a status of the filter element 111 through a pressure sensing assembly 119. In some embodiments, the pressure sensing assembly 119 comprises at least a pressure differential sensor. The pressure differential sensor is structured to provide a feedback signal to the controller 112 that is indicative of a pressure drop across the filter element 111. The pressure drop across the filter element 111 may be the difference in the pressure between an inlet fluid pressure of the filtration system 110 and an outlet fluid pressure of the filtrations system 110. Based on the real-time pressure differential value associated with the filter element 111, the controller 112 calculates the filter loading and the remaining life of the filter element 111.

In other embodiments, the pressure sensing assembly 119 may comprise an upstream pressure sensor positioned upstream of the filter element 111 and configured to measure an upstream pressure thereof. Furthermore, the pressure sensing assembly 119 may also comprise a downstream pressure sensor positioned downstream of the filter element 111 and configured to measure a downstream pressure thereof. The controller 112 may be configured to determine a difference between the downstream pressure and the upstream pressure which corresponds to the differential pressure or pressure drop across the filter element 111.

In some arrangements, the controller 112 provides real-time feedback to an operator device 120. The operator device 120 may be any of a vehicle dashboard or display (such as a liquid crystal display or active matrix display), a smartphone, a remote diagnostics center, or the like. The real-time feedback may relate to engine operating parameters, lubricant characteristics, lubricant life indicators, lubricant change warnings, the at least one lubricant quality parameter, filter element loading information, remaining filter element life, service indicators (e.g., indicating that the lubricant requires changing, indicating that the filter element 111 requires changing, a combined service indicator), and the like. In other arrangements, the operator device 120 may be a remote telematics service device (e.g., a remote server) associated with an operator of the internal combustion engine 102 (or equipment powered by the internal combustion engine). In such arrangements, the operator device 120 may be communicated with via a cellular data connection between the controller 112 and the operator device 120 facilitated via the Internet.

In some arrangements, the controller 112 is communicatively coupled to and receives a feedback signal from a lubricant level sensor 122. The lubricant level sensor 122 is configured to determine a level (i.e., an amount) of the lubricant in the lubricant sump 106 and provide a feedback signal to the controller 112 indicative of the determined level. The controller 112 can interpret the output level signal from the lubricant level sensor 122 to determine the level (i.e., the amount) of the lubricant contained within the lubricant sump 106. In some arrangements, the controller 112 is configured to indicate to a user via the operator device 120 to top up the lubricant when the level of the lubricant within the lubricant sump 106 falls below a predetermined threshold.

Figure 2:
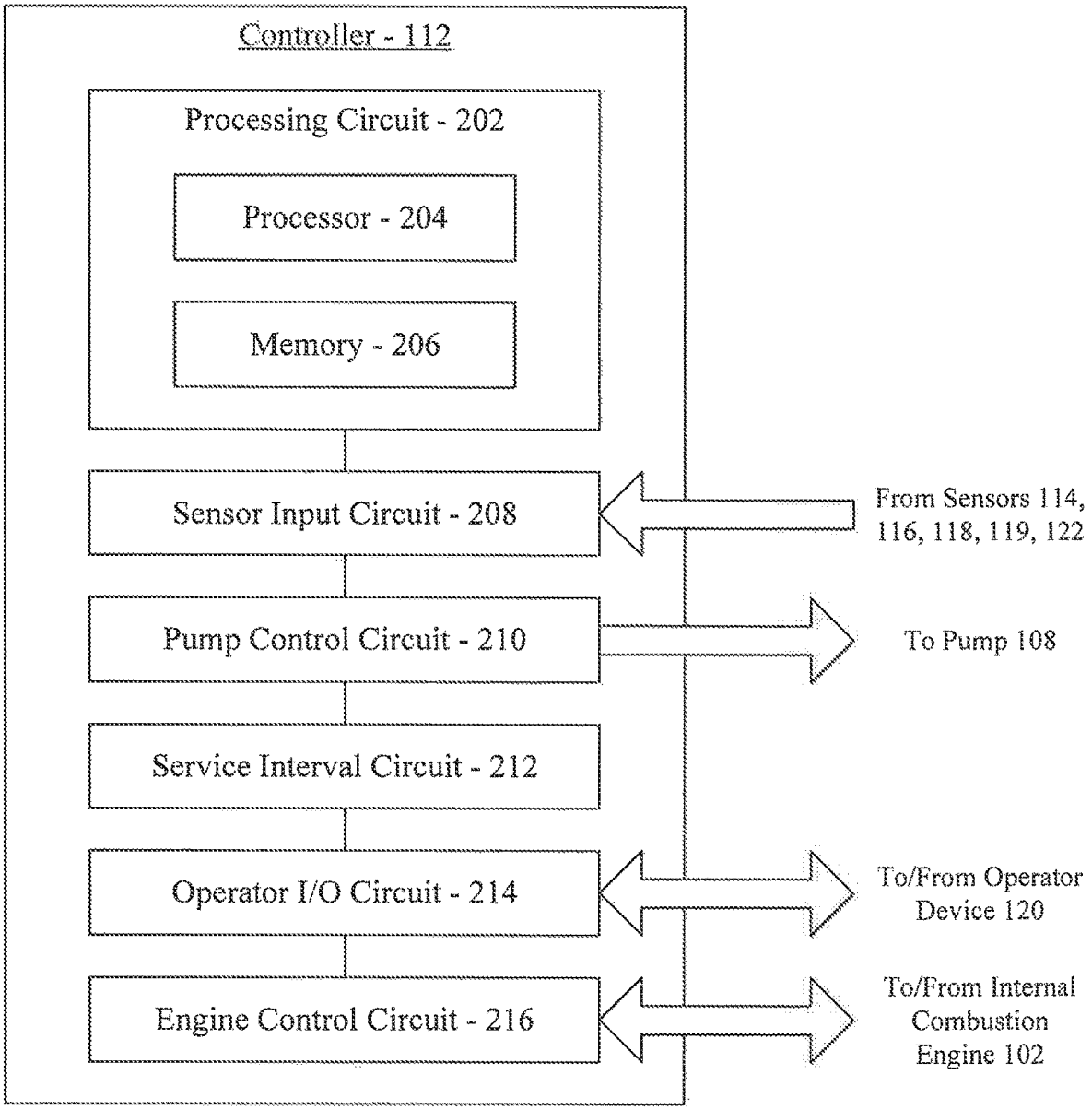
FIG. 2 shows a block diagram of a controller of the lubrication system of FIG. 1.

Referring to FIG. 2, a block diagram of the controller 112 is shown. The controller includes a processing circuit 202. The processing circuit 202 includes a processor 204 and memory 206. The processor 204 may be a general-purpose processor, an application specific integrated circuit (ASIC), a programmable logic controller (PLC) chip, one or more field programmable gate arrays (FPGAs), a digital signal processor (DSP), a group of processing components, or other suitable electronic processing components. The memory 206 may include any of RAM, NVRAM, ROM, Flash Memory, hard disk storage, or the like. The processor 204 is structured to execute instructions stored in the memory 206 that cause the processor 204 to control the operation of the controller 112. In some arrangements, the memory 206 may also include one or more storage devices (e.g., hard drives, flash drives, computer readable media, etc.) either local or remote from the controller 112. The memory 206 can be configured to store look up tables, algorithms or instructions. For example, the memory 206 of the controller 112 can include algorithms or instructions configured to use the output signals generated by the sensors, and use various data conditioning processes and calibratable transfer functions to determine at least one lubricant quality parameter. Such algorithms can include, for example data filtering, temperature conditioning and correcting, numerical methods, decision making algorithms which processes a certain number of successive input data to calculate the desired output. In various arrangements, the memory may include one or more modules to interpret the at least one output signal from the fluid property sensor and determine the one or more lubricant quality parameter therefrom. In further arrangements the memory may include one or more modules to interpret the at least one output signal from the pressure differential sensor and determine the status of the filter element 111 therefrom.

The controller 112 includes a sensor input circuit 208, a pump control circuit 210, a service interval circuit 212, an operator input-output circuit 214, and an engine control circuit 216. In some arrangements, each of the sensor input circuit 208, the pump control circuit 210, the service interval circuit 212, the operator input-output circuit 214, and the engine control circuit 216 are separate from the processing circuit 202 (e.g., as shown in FIG. 2). In other arrangements, the processing circuit 202 includes any or all of the sensor input circuit 208, the pump control circuit 210, the service interval circuit 212, the operator input-output circuit 214, and the engine control circuit 216.

The sensor input circuit 208 is structured to receive feedback signals from the temperature sensor 114, the dielectric sensor 116, the viscosity sensor 118, the density sensor 117, the pressure differential sensor, and the lubricant level sensor 122. The feedback signals may be digital feedback signals or analog feedback signals. The temperature sensor 114 provides a feedback signal indicative of the temperature of the lubricant. The dielectric sensor 116 provides a feedback signal indicative of the dielectric constant of the lubricant. The density sensor 117 provides a feedback signal indicative of the density of the lubricant.

The viscosity sensor 118 provides a feedback signal indicative of the viscosity of the lubricant. The pressure differential sensor provides a feedback signal indicative of the pressure differential across the filter element 111 (i.e., the pressure drop across the filter element 111). The lubricant level sensor 122 provides a feedback signal indicative of the level of lubricant in the lubricant sump 106. In some arrangements, the controller 112 can receive additional feedback signals from other external control modules, associated telematics devices, temperature sensors, NOx sensors, oxygen sensors and/or other sensor of which can be included in the lubrication system 100, or are operatively coupled to the internal combustion engine 102.

The pump control circuit 210 is structured to control the speed of the pump 108. The pump control circuit 210 controls the speed of the pump 108 by sending control signals to the pump and/or by altering the flow of electric power to the pump 108.

The operator input-output circuit 214 is structured to send information (e.g., real-time feedback of engine operating parameters, lubricant characteristics, lubricant life indicators, lubricant change warnings, filter loading information, filter element remaining useful life information, filter element change warnings, etc.) to the operator device 120. Additionally, the operator input-output circuit 214 is structured to receive information from the operator device 120. The information may relate to key on/off situations (e.g., for turning on and off the internal combustion engine 102), service information (e.g., lubricant change information, lubricant grade information, service reset commands, etc.), and the like. The operator input-output circuit 214 may comprise a transceiver (wired or wireless) configured to transmit data to external devices (e.g., the operator device 120, a remote telematics system, a vehicle dashboard, etc.). For example, the controller 112 can light up an indication lamp (e.g., a dashboard light) via the operator input-output circuit 214 when at least one of the lubricant or the filter element 111 require changing.

The engine control circuit 216 is structured to control the operation of the internal combustion engine 102. For example, via the engine control circuit 216, the controller 112 can start or stop the internal combustion engine 102, change the speed of the internal combustion engine 102, change operating parameters of the internal combustion engine 102 (e.g., alter the air/fuel ratio, increase/decrease boost, etc.), and the like. Additionally, through the engine control circuit 216, the internal combustion engine 102 can provide a real-time feedback signal relating to engine operating parameters (e.g., speed, temperature, oil pressure, etc.). In arrangements where the controller 112 does not also function as the engine control unit, the engine control circuit 216 receives real-time feedback of the engine operating parameters from an independent engine control unit that controls the operation of the internal combustion engine 102. In such arrangements, the controller 112 is in communication over a datalink (e.g., a CANBUS link, a J1939 vehicle bus data link) with the engine control unit via the engine control circuit 216.

The service interval circuit 212 is structured to monitor various characteristics of the lubrication system 100, and to make service message determinations based on the monitored characteristics. Specifically, the service interval circuit 212 is structured to receive feedback from the sensor input circuit 208, the engine control circuit 216 (e.g., feedback indicating the real-time operating parameters of the internal combustion engine), and the operator input-output circuit 214 (e.g., lubricant grade information, installed filter element operating parameters, etc.) such that the service interval circuit 212 can determine: (1) when new lubricant has been received in the lubrication system 100, (2) what the viscosity grade of the lubricant is, and (3) a dynamic determination of when the lubricant should be replaced. The operation of the controller 112, and specifically the service interval circuit 212, with respect to the lubricant monitoring aspects of the service interval circuit 212 are described in greater detail below with respect to FIGS. 3, 4A, 4B, and 4C.

The service interval circuit 212 is further structured to monitor the real-time pressure drop across the filter element 111. Based on the real-time pressure drop across the filter element 111 and known parameters about the filter element 111 (e.g., pressure drop threshold at time of replacement, estimated filter element life, etc.) and general parameters of the lubrication system 100 (e.g., engine operating parameters, lubricant information, lubricant contamination information, lubricant pressure, etc.), the service interval circuit 212 determines a current loading parameter of the filter element 111 and a remaining useful life of the filter element 111. The operation of the controller 112, and specifically the service interval circuit 212, with respect to the filter element 111 monitoring aspects of the service interval circuit 212 are described in greater detail below with respect to FIG. 5.

Still further, the service interval circuit 212 is structured to synchronize the service intervals of the lubricant and the filter element 111. Based on the filter element 111 monitoring and the lubricant monitoring, the service interval circuit 212 determines an optimal service interval such that both the lubricant and the filter element 111 can be replaced during the same service instead of requiring two separate services. The synchronization of the service events results in less downtime for the internal combustion engine 102 (and equipment powered by the internal combustion engine 102). The service interval synchronization aspects of the service interval circuit 212 are described in further detail below with respect to FIG. 6.

Figure 3:
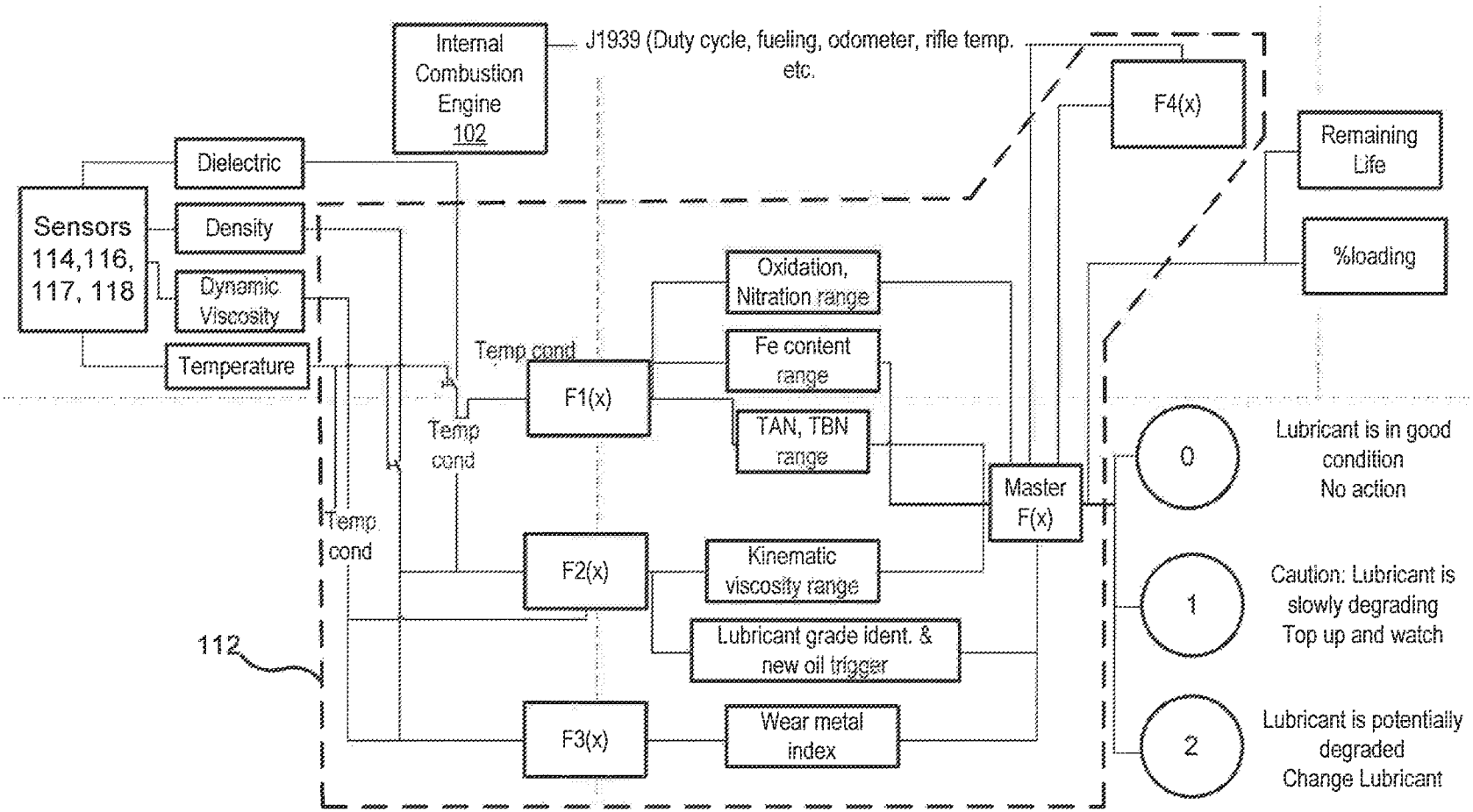
FIG. 3 is a schematic flow diagram of various output signals of the fluid property sensors of the lubrication system of FIG. 1 that are received and interpreted by the controller.

FIG. 3 is a schematic flow diagram of output signals generated by the fluid property sensors 114, 116, 117, and 118 which are indicative of various lubricant properties and are interpreted by the controller 112 to determine a plurality of lubricant quality parameters. The controller 112 then uses the lubricant quality parameters to determine a quality of the lubricant which is indicated to the user.

As shown in FIG. 3, the fluid property sensors 114, 116, 117, and 118 generate output signals indicative of the dielectric constant, density, dynamic viscosity and temperature of the lubricant. The controller 112 interprets the output signals from the sensors 114, 116, 117, and 118 to determine an oxidation and/or nitration range, the presence/absence/concentration of wear materials in the lubricant (e.g., an iron (Fe) content) or a wear metal index, and a TAN and TBN range of the lubricant as each of these factors can impact (i.e., raise or lower) the dielectric constant of the lubricant. In arrangements where a wear metal index is determined by the controller 112, the controller 112 can interpret a combination of the viscosity, density, and dielectric of the lubricant to determine the wear metal index. The controller 112 also interprets the output signal corresponding to the density of the lubricant and the dynamic viscosity of the lubricant and uses the density of the lubricant, the dynamic viscosity of the lubricant, and the temperature to determine a kinematic viscosity range of the lubricant. Furthermore, the controller 112 also interprets the output signal corresponding to the dynamic viscosity of the lubricant and the dielectric constant of the lubricant and uses the dynamic viscosity, dielectric constant, and the temperature of the lubricant to approximate an amount of wear metal present in the lubricant. Additionally, the controller 112 interprets the output from the internal combustion engine 102 (either directly in arrangements where the controller 112 also functions as an ECU, or indirectly in arrangements where the controller 112 receives feedback from an ECU associated with the internal combustion engine 102), which includes any of the above-discussed operating parameters of the internal combustion engine 102.

The controller 112 then uses each of the lubricant quality parameters and/or the engine operating parameters to predict a qualitative condition of the lubricant or the quality of the lubricant, and indicates the quality of the lubricant to the user. For example, the controller 112 can indicate the quality of the lubricant using a numeric code. In a particular embodiment, the numeric code can indicate a quality of the lubricant as 0, 1 or 2 where 0 represents that the lubricant (e.g., oil) is in good condition and no action is required, 1 represents that the lubricant is slowly degrading and advises the user to top up the lubricant and monitor the lubricant, and 2 represents that the lubricant is potentially degraded or has been contaminated with an inappropriate fluid (e.g. diesel fuel), and should be changed. Based on the quality of the lubricant, the controller 112 can also determine and indicate a potential failure mode associated with the lubricant based on output from the sensors 114, 116, 117, and 118 and the ECU, which can point to a root cause behind lubricant degradation (e.g., fuel leaks, coolant leaks, bearing wear, etc.). Further, the controller 112 can indicate an estimate of remaining life of a lubricant filter (e.g., an oil filter) and a percent loading of the lubricant filter associated with the lubricant. One such example is described in further detail below with respect to FIGS. 4A, 4B, and 4C.

Figure 4A:
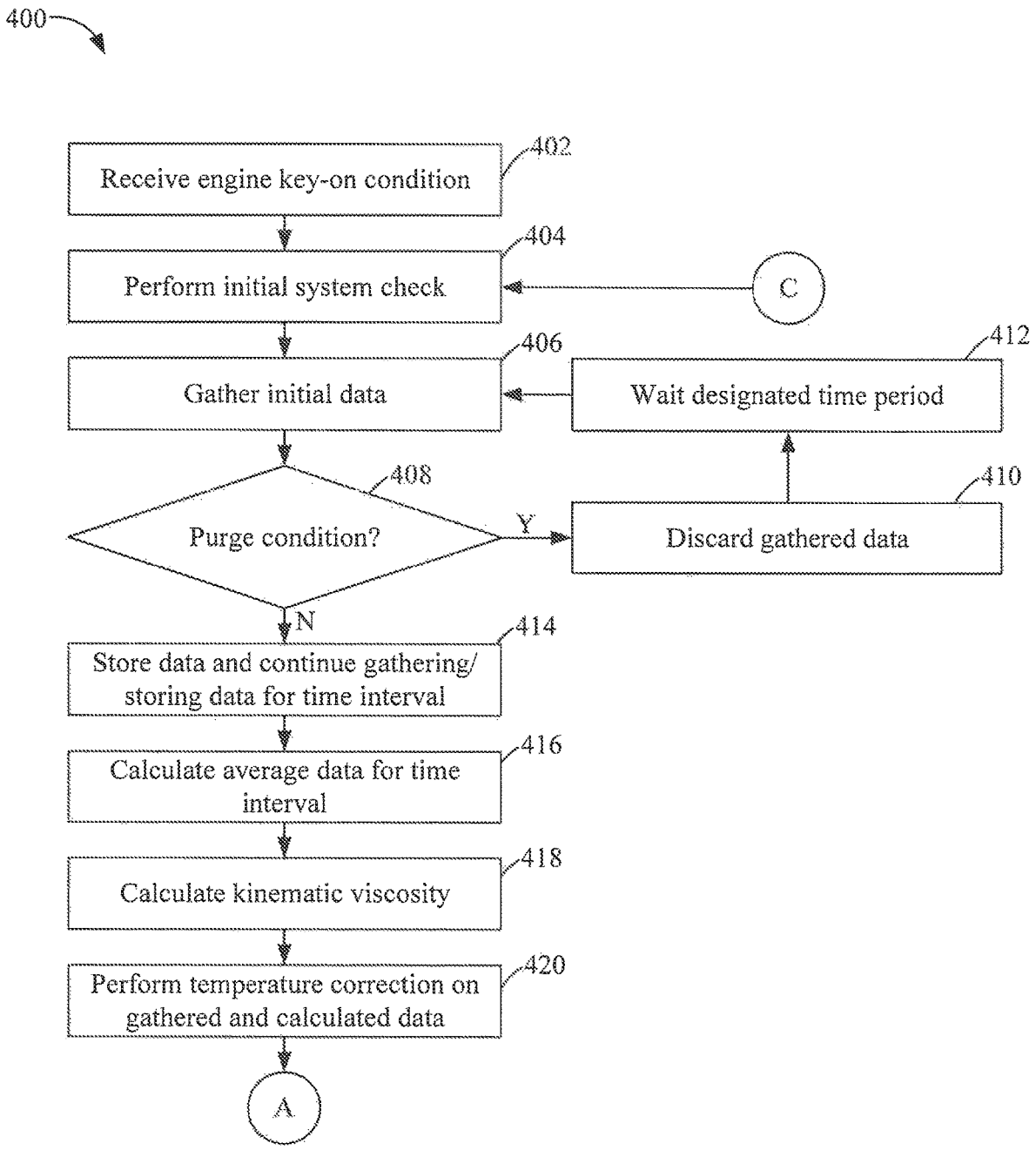
FIGS. 4A, 4B, and 4C collectively show a flow diagram of a method of monitoring a lubrication system according to an example embodiment.
Figure 4B:
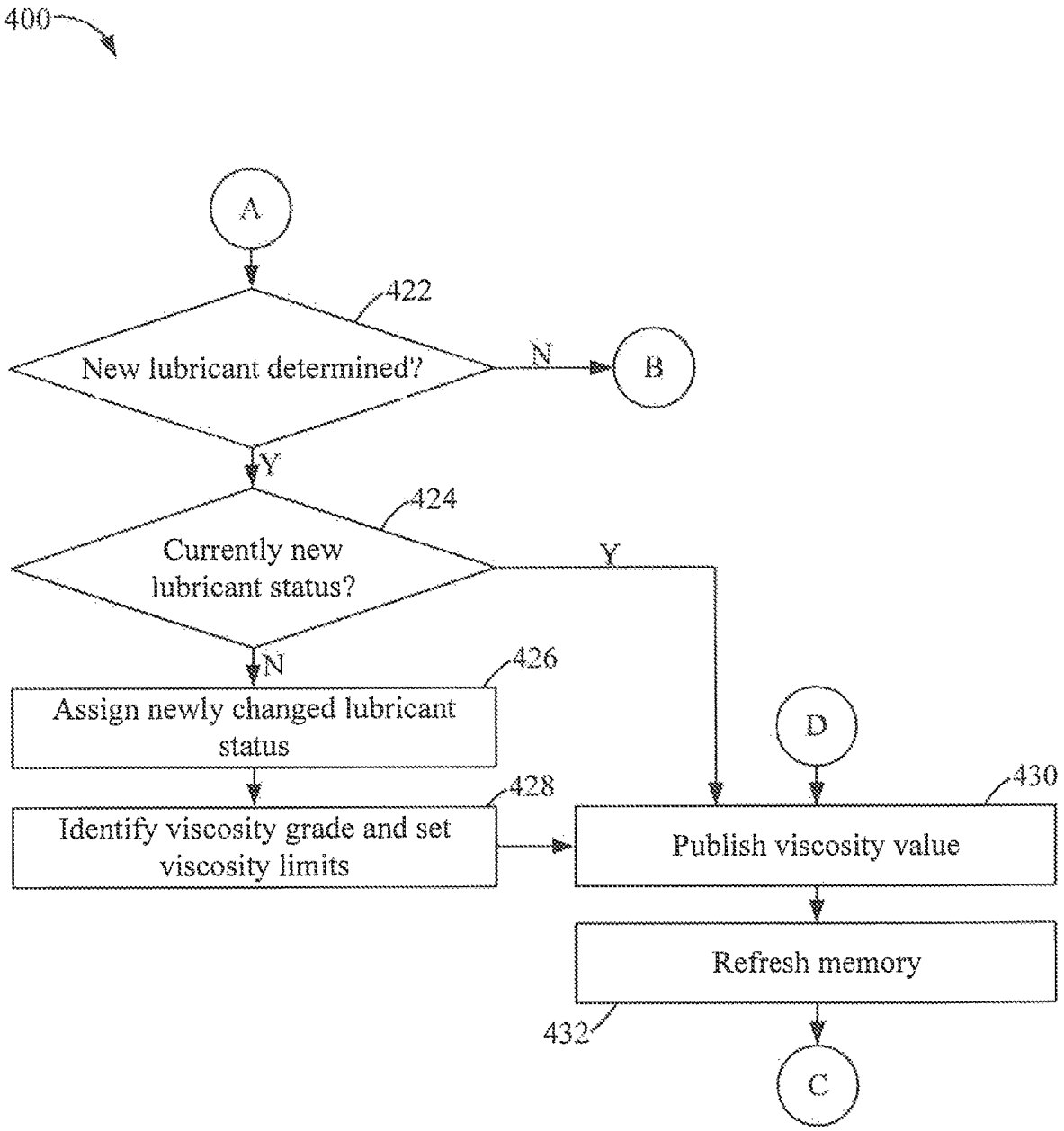
Figure 4C:
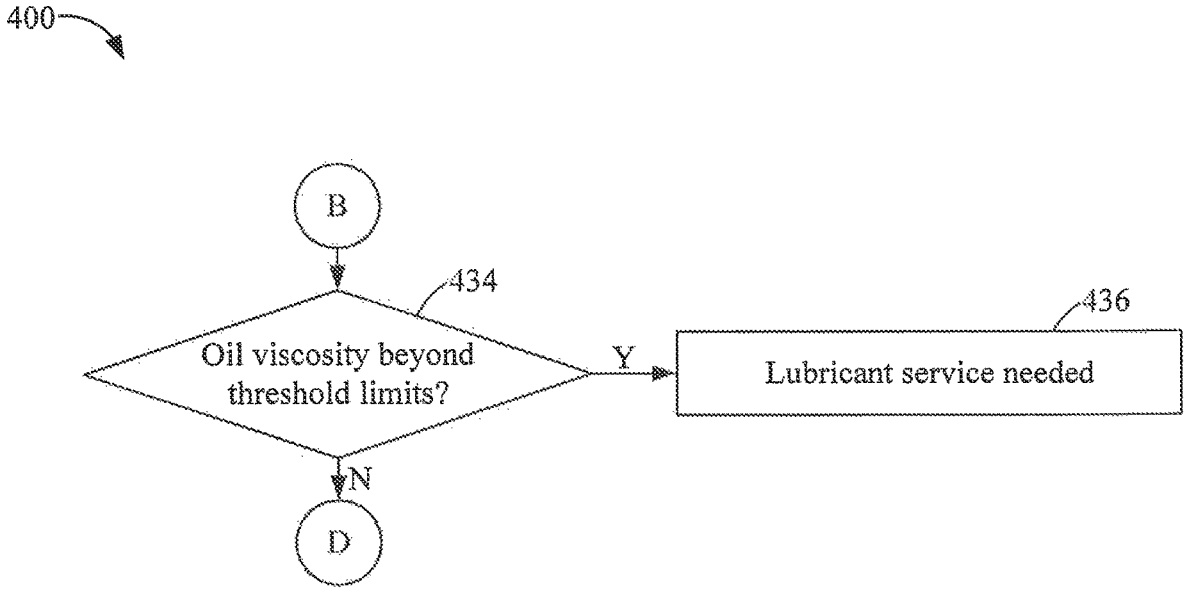

Referring to FIGS. 4A, 4B, and 4C, a flow diagram of a method 400 of monitoring the lubrication system 100 is according to an example embodiment. The method 400 is performed by the controller 112 of the lubrication system 100. The method 400 begins when an engine key-on condition is received by the controller 112, at 402. In some arrangements, the engine key-on condition is received via the engine control circuit 216. In other arrangements where the internal combustion engine 102 is controlled by a separate engine control unit, the indication of the engine key-on condition is received from the engine control unit. The engine key-on condition indicates that an operator of the internal combustion engine 102 (e.g., a driver of a vehicle powered by the internal combustion engine 102) has started the internal combustion engine 102.

An initial system check is performed, at 404. The controller 112 performs an initial system check of the lubrication system 100. The controller 112 verifies that the feedback signals from the temperature sensor 114, the dielectric sensor 116, the density sensor 117, and the viscosity sensor 118 are normal. The controller 112 also verifies that the engine operating parameters are being communicated to the controller 112 (e.g., via the engine control circuit 216 or via an engine control module in communication with the controller 112). If the controller 112 detects an error in any of the sensors or in the feedback from the internal combustion engine 102, the controller 112 can issue an error message to the operator device 120, and the method 400 ends. However, the description of the method 400 continues under the assumption that the initial system check passes.

Initial data is gathered, at 406. The controller 112 gathers initial data from the feedback signals from the temperature sensor 114, the dielectric sensor 116, the density sensor 117, and the viscosity sensor 118 via the sensor input circuit 208. Additionally, the controller 112 gathers initial engine operating parameters from the internal combustion engine 102 via the engine control circuit 216, The operating parameters include engine speed, block temperature, lubricant pressure, odometer reading, engine time, and the like. The controller 112 determines if there is a data purge condition, at 408. A data purge condition is a condition in which there is a lot of noise (i.e., inconsistency) in the data. For example, a data purge condition may exist immediately after a cold-start of the internal combustion engine 102 or before the fluids flowing through the internal combustion engine 102 have reached optimal temperatures (e.g., before the lubricant has heated up to an optimal operating temperature). If a purge condition is detected at 408, the data gathered at 406 is discarded by the controller 112. The controller 112 then waits a designated period of time at 412. The designated period of time may be, for example, ten minutes, twenty minutes, one hour, or the like. By waiting for the designated period of time to expire, the controller 112 allows the purge condition to end before attempting to gather data. After the designated period of time expires, the method returns to 406, and initial data is gathered again.

In some arrangements, viscosity and temperature information gathered by the controller 112 during the key on situations can be used to determine a viscosity index, which requires viscosity data of the lubricant for at least two different temperatures. Viscosity index is a measure of the change in viscosity of the lubricant as a function of temperature, which is different than the viscosity grade of the lubricant. The viscosity grade of the lubricant refers to the viscosity of the lubricant at a single temperature. The controller 112 can determine viscosity index, which is useful when multi-viscosity lubricant is used. Viscosity index of the lubricant can be determined based on the same inputs as determining a viscosity of the lubricant. The viscosity index is determined using corresponding viscosity and temperature inputs during a time period following a key on situation when both temperature and viscosity are changing. Depending on the operating conditions of the internal combustion engine, lubricants of different viscosity indexes may be used (e.g., depending on the climate and weather season). Accordingly, for equipment operating in extreme weather operating conditions, the viscosity index may serve as an indicator as to when the lubricant requires changing. In such arrangements, the controller 112 can use the viscosity index in addition to or instead of viscosity grade as an indicator for determining when the lubricant requires changing (e.g., as described below with respect to 434 through 436).

If a purge condition does not exist at 408, the method 400 continues to 414, where the controller 112 continues to gather and store data for a time interval. The controller 112 continues to gather engine operating parameters and sensor feedback signals during the time interval. The gathered data includes at least the temperature of the lubricant (e.g., via the temperature sensor 114), the dielectric constant of the lubricant (e.g., via the dielectric sensor 116), the viscosity of the lubricant (e.g., via the viscosity sensor 118), the density of the lubricant (e.g., via the density sensor 117), and engine operating parameters. The time interval may be, for example, ten minutes, twenty minutes, an hour, two hours, or the like. The data may be gathered at set subintervals throughout the time interval (e.g., every ten seconds during the duration of the time interval). The gathered data is stored in the memory of the controller 112. In some arrangements, during the data gathering at 414 or after the time interval has expired, the data may be adjusted based on the sensed temperature of the lubricant. In such arrangements, the controller 112 (e.g., the service interval circuit 212 of the controller 112) may calculate a normalized viscosity of the lubricant that accounts for the temperature of the lubricant by referencing normalized viscosities in a viscosity-temperature reference table. The viscosity may be normalized to any temperature (e.g., 100 degrees Celsius). In other arrangements, the temperature correction is performed later (as described herein).

After storing and gathering the data at 414, the controller 112 calculates the averages for the data gathered at 416. By calculating the average values, the data is normalized to account for noise that may occur during operation of the internal combustion engine 102. In some arrangements, the kinematic viscosity is calculated at 418. In such arrangements, the viscosity sensor 118 provides a feedback signal that indicates a dynamic viscosity of the lubricant. The controller 112 calculates the kinematic viscosity by dividing the dynamic viscosity by the density of the lubricant. The density of the lubricant may be determined either by a density sensor structured to provide a feedback signal to the controller 112 that indicates the density of the lubricant or through operator input received via the operator device 120. In arrangements where the viscosity sensor 118 provides a feedback signal that indicates a kinematic viscosity of the lubricant, process 418 is skipped.

The controller 112 performs temperature correction calculations on the gathered data and the determined kinematic viscosity of the lubricant, at 420. Accordingly, the controller 112 may calculate a temperature normalized viscosity (dynamic and/or kinematic) of the lubricant that accounts for the temperature of the lubricant by referencing normalized viscosities in a viscosity-temperature reference table. The viscosity may be normalized to any temperature (e.g., 100 degrees Celsius). Additionally, the controller 112 may calculate temperature normalized dielectric of the lubricant by referencing normalized dielectrics in a dielectric constant-temperature reference table or by performing a mathematical transformation of the gathered data.

The controller 112 determines if the lubricant is new, at 422 (FIG. 4B). The controller 112 analyzes the average dielectric for the timer interval as calculated at 416 and/or as normalized at 420. Generally, the lubricant's measured dielectric constant is compared against a known dielectric constant for new lubricant and old lubricant. As new lubricant begins to degrade with use, the dielectric constant increases. If the measured dielectric constant is within a threshold number of the known dielectric constant for unused lubricant, then the controller 112 determines that the lubricant is new lubricant. If the measured dielectric constant is outside of the threshold number of the known dielectric constant for unused lubricant, the controller 112 determines that the lubricant is old lubricant. As used here, "new" lubricant is lubricant that was recently replaced, and "old" lubricant is lubricant that has degraded enough to cause the dielectric constant of the lubricant to increase beyond a threshold relative to the unused lubricant but not necessarily needing replacement. In some arrangements, the determination as to whether the lubricant is old or new lubricant is also based at least in part on the kinematic viscosity of the lubricant as determined at 418 and/or as temperature normalized at 420. In some arrangements, the controller 112 also determines whether additional fluid (appropriate or not) was added to the lubrication system 100 (e.g., into the lubricant sump 106), at 422. For example, based on dielectric, viscosity, and density changes in the fluid, the controller 112 may determine that some new lubricant of an appropriate viscosity was added into the lubrication system 100 or that a different fluid (i.e., a not appropriate fluid, such as lubricant of an incorrect viscosity grade, fuel, water, etc.) was added to the lubrication system 100.

If the controller 112 determines that the lubrication system 100 is circulating new lubricant at 422, the controller 112 determines if the prior lubricant status (i.e., at the prior cycle of the method 400) was new lubricant or old lubricant at 424. If the prior lubricant status was old lubricant, the controller 112 determines that the lubricant in the lubrication system 100 was recently changed. If the prior lubricant status was new lubricant, then the controller 112 determines that the lubricant in the lubrication system 100 is the same lubricant as detected during the prior cycle of the method 400. In some operating situations, the lubrication system 100 may be "topped off" with additional lubricant by adding more lubricant to the lubrication system 100 without performing a complete lubricant change. Such top offs may impact the overall dielectric of the lubricant circulating in the lubrication system 100, but in a lesser manner than a complete lubricant change. For example, a top off may cause the lubricant dielectric to shift from old to new if the lubricant was just beyond the old threshold dielectric, and the new lubricant moves the total dielectric into the new status range. However, the controller 112 still determines the lubricant status as being old or new in the same manner as described above, and the method 400 continues as described.

If the controller 112 determines that the lubricant in the lubrication system was changed at 424, the controller assigns a newly changed lubricant status at 426. In doing so, the controller 112 updates the memory with the newly changed lubricant status and records the time of the newly changed lubricant status decision (e.g., in engine time, in odometer miles, etc.). The viscosity grade is identified, and viscosity limits are set, at 428. In some arrangements, the controller 112 identifies the viscosity grade (e.g., 10w-30, 5w-30, SAE 30, SAE 40, etc.) based on the determined viscosity of the lubricant. In other arrangements, the controller 112 receives the viscosity grade from the operator (e.g., the technician that just changed the lubricant of the internal combustion engine 102) via the operator device 120. Based on the viscosity grade, the controller 112 identifies the viscosity limits (e.g., the upper viscosity limit and the lower viscosity limit) by referencing a look-up table stored in the memory 206. The viscosity limits represent the threshold viscosity readings for triggering an alert to the operator via the operator device 120. If the controller 112 determines that the lubricant in the lubrication system was not changed at 424, processes 426 and 428 are skipped.

The viscosity value is published at 430. The controller 112 publishes the determined viscosity value of the lubricant to the operator device 120. If the viscosity value is above or below one of the viscosity thresholds, the publishing of the viscosity value may be achieved with the triggering of a maintenance warning (e.g., an oil change light on a dashboard of the vehicle powered by the internal combustion engine 102). The memory is refreshed at 432. The controller 112 resets the memory 206 such that a new set of data can be captured. In some arrangements, only the portion of the memory 206 containing the data captured at 404 and 406 is refreshed. In such arrangements, the portion of the memory 206 may function as a first-in-first-out buffer that is structured only to have enough space to record the data for the time interval set forth in 414. After the memory is refreshed at 432, the method returns to 404 (returning to FIG. 4A).

Returning to 422, if the controller 112 determines that the lubrication system 100 is circulating old lubricant at 422, the controller 112 determines if the measured viscosity of the lubricant (as calculated at either 418 or 422) is beyond the threshold limits, at 434 (FIG. 4C). The lubricant viscosity threshold limits were set during a previous cycle of the method 400 at 428. If the measured viscosity is above the upper threshold or below the lower threshold, the controller 112 determines that lubricant service is needed, at 436. In some arrangements, the lubricant service is a lubricant change (e.g., an oil change) or a lubricant top-off. As described below in further detail with respect to FIG. 6, in response to 436, the controller can initiate a warning or alert that it is presented or exhibited to the operator via the operator device 120 (e.g., as a dashboard light, as a push notification, as an audible alert, as an e-mail alert, etc.) indicating that the lubricant service is needed (as described in further detail below with respect to FIG. 6). If the measure viscosity is within the upper threshold and the lower threshold, the method 400 continues to process 430 as described above. In addition to a lubricant service warning or alert, the controller 112 can trigger other warnings, such as notifying an operator if an inappropriate fluid has been added to the lubrication system 100 (e.g., if lubricant of a wrong viscosity grade was added, if fuel was added instead of lubricant, etc.). Such a warning may also indicate to the operator that the filter requires changing due to potential damage caused by the inappropriate fluid being circulated through the lubrication system 100.

The method 400 continues to cycle while the internal combustion engine 102 is running. When the internal combustion engine 102 is turned off (e.g., after the operator of the internal combustion engine 102 triggers a key-off condition), the method 400 stops.

Figure 5:
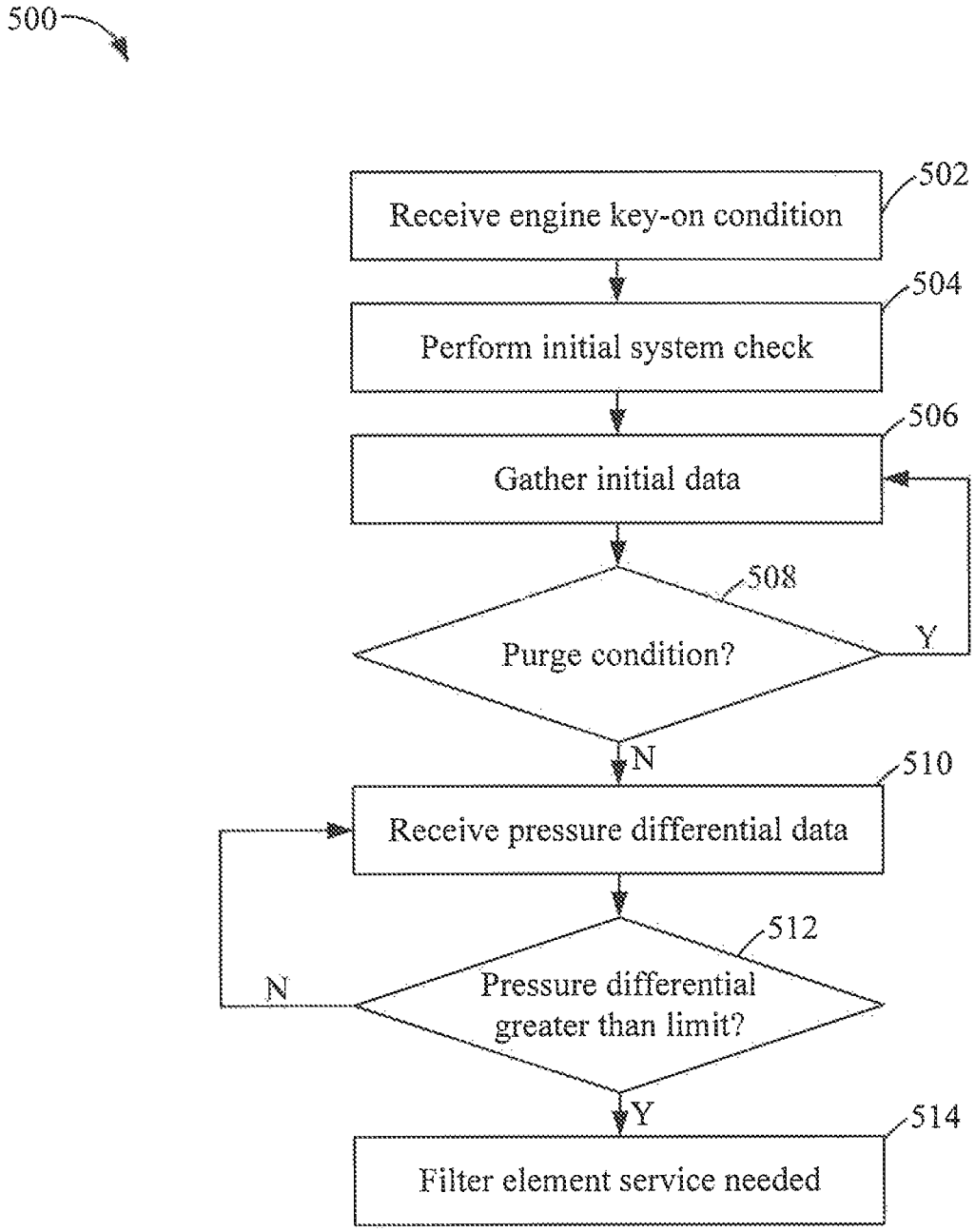
FIG. 5 shows a flow diagram of a method of monitoring a filter element of a lubrication system according to an example embodiment.

Referring to FIG. 5, a flow diagram of a method 500 of monitoring the filter element 111 of the lubrication system 100 is shown according to an example embodiment. The method 500 is performed by the controller 112 of the lubrication system 100. The method 500 begins when an engine key-on condition is received by the controller 112, at 502. In some arrangements, the engine key-on condition is received via the engine control circuit 216. In other arrangements where the internal combustion engine 102 is controlled by a separate engine control unit, the indication of the engine key-on condition is received from the engine control unit. The engine key-on condition indicates that an operator of the internal combustion engine 102 (e.g., a driver of a vehicle powered by the internal combustion engine 102) has started the internal combustion engine 102.

An initial system check is performed, at 504. The controller 112 performs an initial system check of the lubrication system 100. The controller 112 verifies that the feedback signals from the pressure differential sensor are normal. The controller 112 also verifies that the engine operating parameters are being communicated to the controller 112 (e.g., via the engine control circuit 216 or via an engine control module in communication with the controller 112). If the controller 112 detects an error in any of the sensors or in the feedback from the internal combustion engine 102, the controller 112 can issue an error message to the operator device 120, and the method 500 ends. However, the description of the method 500 continues under the assumption that the initial system check passes.

Initial data is gathered, at 506. The controller 112 gathers initial data from the feedback signals from the pressure differential sensor via the sensor input circuit 208. Additionally, the controller 112 gathers initial engine operating parameters from the internal combustion engine 102 via the engine control circuit 216. The operating parameters include engine speed, block temperature, lubricant pressure, odometer reading, engine time, and the like. The controller 112 determines if there is a data purge condition, at 508. A data purge condition is a condition in which there is a lot of noise (i.e., inconsistency) in the data. For example, a data purge condition may exist immediately after a cold-start of the internal combustion engine 102 or before the fluids flowing through the internal combustion engine 102 have reached optimal temperatures (e.g., before the lubricant has heated up to an optimal operating temperature). If a purge condition is detected at 508, the data gathered at 506 is discarded by the controller 112. The controller 112 then waits a designated period of time (e.g., ten minutes, twenty minutes, one hour, or the like) to allow the purge condition to end before attempting to gather data. After the designated period of time expires, the method returns to 506, and initial data is gathered again.

Pressure differential data is received, at 510. The controller 112 receives pressure differential data corresponding to the pressure drop across the filter element 111 from the pressure differential sensor via the sensor input circuit 208. In some arrangements, the pressure differential data is used to determine a remaining useful life of the filter element 111. The controller 112 determines if the pressure differential exceeds a limit of pressure differential at 512. In some arrangements, the pressure differential limit is specific to the type of filter element installed in the lubrication system 100 and is input by a technician at the time of installation of the filter element 111. If the pressure differential received at 510 does not exceed the limit, the method returns to 510. If the pressure differential received at 510 exceeds the limit, the controller 112 determines that filter element service is needed at 514. In some arrangements, the filter element service corresponds to a change of the filter element 111 (e.g., removing the installed filter element 111 and replacing the filter element 111 with a new filter element). As described below in further detail with respect to FIG. 6, in response to 514, the controller 112 can initiate a warning or alert that it is presented or exhibited to the operator via the operator device 120 (e.g., as a dashboard light, as a push notification, as an audible alert, as an e-mail alert, etc.) indicating that the filter element service is needed.

Figure 6:
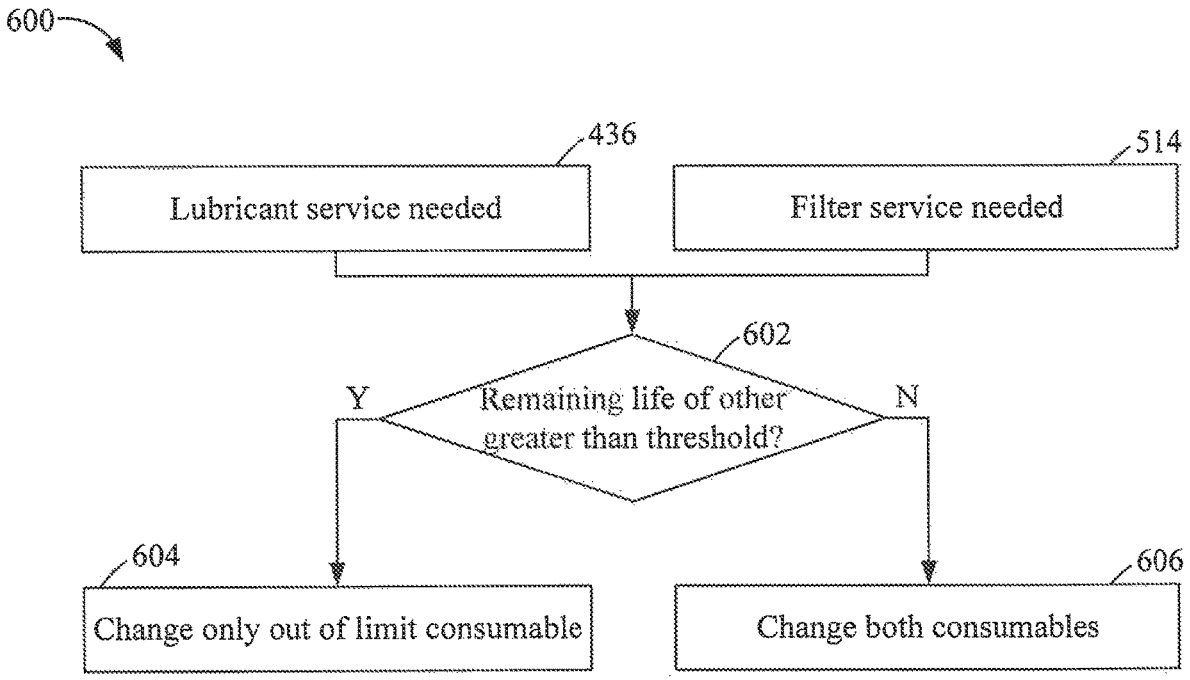
FIG. 6 shows a flow diagram of a method of synchronizing service alerts for a lubricant service and a filter element service according to an example embodiment.

Referring to FIG. 6, a flow diagram of a method 600 of synchronizing service alerts for a lubricant service and a filter element service is shown according to an example embodiment. The method 600 is performed by the controller 112 of the lubrication system 100. The method 600 is triggered with a determination that a lubricant service is needed (step 436 of the method 400) or a determination that a filter element service is needed (step 514 of the method 500).

After one of the triggers is received (at 436 or 514), the controller 112 determines whether the remaining life of the non-triggered consumable (i.e., the other of the lubricant or the filter element 111) is greater than a threshold remaining life, at 602. If the trigger to the method 600 was the determination that the lubricant service is needed, the controller 112 compares a current remaining useful life of the filter element 111 to a threshold remaining useful life. The threshold remaining useful life may be, for example, greater than half of the expected useful life of the filter element 111, greater than a quarter of the expected useful life of the filter element 111, or the like. If the trigger to the method 600 was the determination that the filter element service is needed, the controller 112 compares a current remaining useful life of the lubricant to a threshold remaining useful life. The threshold remaining useful life may be, for example, greater than half of the expected useful life of the filter element 111, greater than a quarter of the expected useful life of the filter element 111, or the like.

If the remaining useful life of the non-triggered consumable is greater than the threshold remaining useful life, then the controller 112 initiates a warning or alert indicating that the triggering consumable (i.e., whichever of the lubricant or the filter element 111 is associated with the trigger that initiated the method 600) requires changing at 604. If the remaining useful life of the non-triggered consumable is less than the threshold remaining useful life, then the controller 112 initiates a warning or alert indicating that both the consumables (i.e., both the lubricant and the filter element 111) require changing at 606. In either situation, the alert or warning is presented or exhibited to the operator via the operator device 120 (e.g., as a dashboard light, as a push notification, as an audible alert, as an e-mail alert, etc.). Accordingly, when the system determines that both the lubricant and the filter element 111 require changing, the services for the lubricant and the filter element 111 can be synchronized (i.e., performed at the same time) thereby limiting the amount of service downtime associated with the internal combustion engine 102.

The above-described systems and methods monitor and determine various lubricant quality parameters and filter element pressure drop, which can be used to determine real-time estimates of remaining useful life for both the filter element and the lubricants. The respective remaining useful life calculations are used by the described systems and methods to determine change intervals for the lubricant and the filter element. The change intervals can be synchronized by the systems and methods to reduce the amount of down time due to servicing of the lubrication system. It should be understood that the above-described systems and methods can be utilized to monitor other fluid circulation or delivery systems, such as hydraulic fluid circulation systems, coolant circulation systems, transmission fluid circulation systems, prime mover fluid systems, and the like. In these arrangements, the fluid may be fed to a device or machine other than an internal combustion engine, such as a hydraulic motor or a radiator.

It should be noted that any use of the term "example" herein to describe various embodiments is intended to indicate that such embodiments are possible examples, representations, and/or illustrations of possible embodiments (and such term is not intended to connote that such embodiments are necessarily extraordinary or superlative examples).

It is important to note that the construction and arrangement of the various example embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any method processes or steps may be varied or re-sequenced according to alternative embodiments. Additionally, features from particular embodiments may be combined with features from other embodiments as would be understood by one of ordinary skill in the art. Other substitutions, modifications, changes and omissions may also be made in the design, operating conditions and arrangement of the various example embodiments without departing from the scope of the present invention.

Additionally, the format and symbols employed are provided to explain the logical steps/processes of the schematic diagrams and are understood not to limit the scope of the methods illustrated by the diagrams. Although various arrow types and line types may be employed in the schematic diagrams, they are understood not to limit the scope of the corresponding methods. Indeed, some arrows or other connectors may be used to indicate only the logical flow of a method. For instance, an arrow may indicate a waiting or monitoring period of unspecified duration between enumerated steps or processes of a depicted method. Additionally, the order in which a particular method occurs may or may not strictly adhere to the order of the corresponding steps or processes shown. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and program code.

Some of the functional units described in this specification have been labeled as circuits, in order to more particularly emphasize their implementation independence. For example, a circuit may be implemented as a hardware circuit comprising custom very-large-scale integration (VLSI) circuits or gate arrays, off-the-shelf semiconductors such as logic chips, transistors, or other discrete components. A circuit may also be implemented in programmable hardware devices such as field programmable gate arrays, programmable array logic, programmable logic devices or the like.

As mentioned above, circuits may also be implemented in machine-readable medium for execution by various types of processors, such as the processor 204 of the controller 112. An identified circuit of executable code may, for instance, comprise one or more physical or logical blocks of computer instructions, which may, for instance, be organized as an object, procedure, or function. Nevertheless, the executables of an identified circuit need not be physically located together, but may comprise disparate instructions stored in different locations which, when joined logically together, comprise the circuit and achieve the stated purpose for the circuit. Indeed, a circuit of computer readable program code may be a single instruction, or many instructions, and may even be distributed over several different code segments, among different programs, and across several memory devices. Similarly, operational data may be identified and illustrated herein within circuits, and may be embodied in any suitable form and organized within any suitable type of data structure. The operational data may be collected as a single data set, or may be distributed over different locations including over different storage devices, and may exist, at least partially, merely as electronic signals on a system or network.

The computer readable medium (also referred to herein as machine-readable media or machine-readable content) may be a tangible computer readable storage medium storing computer readable program code. The computer readable storage medium may be, for example, but not limited to, an electronic, magnetic, optical, electromagnetic, infrared, holographic, micromechanical, or semiconductor system, apparatus, or device, or any suitable combination of the foregoing. As alluded to above, examples of the computer readable storage medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store computer readable program code for use by and/or in connection with an instruction execution system, apparatus, or device.

The computer readable medium may also be a computer readable signal medium. A computer readable signal medium may include a propagated data signal with computer readable program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport computer readable program code for use by or in connection with an instruction execution system, apparatus, or device. As also alluded to above, computer readable program code embodied on a computer readable signal medium may be transmitted using any appropriate medium, including but not limited to wireless, wireline, optical fiber cable, Radio Frequency (RF), or the like, or any suitable combination of the foregoing. In one embodiment, the computer readable medium may comprise a combination of one or more computer readable storage mediums and one or more computer readable signal mediums. For example, computer readable program code may be both propagated as an electro-magnetic signal through a fiber optic cable for execution by a processor and stored on RAM storage device for execution by the processor.

Computer readable program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The computer readable program code may execute entirely on a computer (such as via the controller 112 of FIG. 1), partly on the computer, as a stand-alone computer-readable package, partly on the computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). The program code may also be stored in a computer readable medium that can direct a computer, other programmable data processing apparatus, or other devices to function in a particular manner, such that the instructions stored in the computer readable medium produce an article of manufacture including instructions which implement the function/act specified in the schematic flowchart diagrams and/or schematic block diagrams block or blocks.

Accordingly, the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A fluid delivery system comprising:

a filtration system comprising a filter element;

a pressure sensing assembly configured to output a pressure signal indicating a pressure drop across the filter element;

a viscosity sensor configured to output a viscosity feedback signal indicating a viscosity of a fluid;

a dielectric sensor configured to output a dielectric feedback signal indicating a dielectric constant of the fluid; and a controller comprising a sensor input circuit and a service interval circuit, the sensor input circuit configured to receive the pressure signal, the viscosity feedback signal, and the dielectric feedback signal, the service interval circuit configured to:

determine at least one of (i) that the filter element should be replaced based at least in part on the pressure signal and (ii) that the fluid should be replaced based at least in part on the viscosity feedback signal and the dielectric feedback signal;

responsive to determining that the filter element should be replaced, determine that the fluid should be replaced based on a remaining useful life of the fluid being less than a fluid expected useful life threshold, wherein the fluid expected useful life threshold is greater than a portion of an expected useful life of the fluid;

responsive to determining that the fluid should be replaced, determine that the filter should be replaced based on a remaining useful life of the filter being less than a filter expected useful life threshold, wherein the filter expected useful life threshold is greater than a portion of an expected useful life of the filter; and initiate a service alert to an operator device in response to determining that at least one of the fluid or the filter element should be replaced.

2. The fluid delivery system of claim 1, wherein the fluid comprises a lubricant.

3. The fluid delivery system of claim 1, wherein the pressure sensing assembly comprises a differential pressure sensor, and wherein the pressure signal comprises a pressure differential feedback signal.

4. The fluid delivery system of claim 1, wherein the controller is further configured to initiate a service alert to an operator device when at least one of the filter element or the fluid requires changing.

5. The fluid delivery system of claim 4, wherein the controller is configured to initiate the service alert to the operator device when both the filter element and the fluid require changing.

6. The fluid delivery system of claim 1, wherein the controller is operably connected to an internal combustion engine.

7. The fluid delivery system of claim 6, wherein the controller comprises an engine control module structured to control the operation of the internal combustion engine.

8. The fluid delivery system of claim 1, further comprising a temperature sensor structured to output a temperature feedback signal indicating a temperature of the fluid.

9. The fluid delivery system of claim 8, wherein the controller is structured to normalize the viscosity of the fluid based on the temperature of the fluid.

10. The fluid delivery system of claim 1, wherein the dielectric sensor and the viscosity sensor are positioned along a fluid flow conduit downstream of the filtration system and upstream of a fluid sump with respect to the flow direction of the fluid through the system.

11. The system of claim 1, wherein the dielectric sensor and the viscosity sensor are integrated into a single sensor housing.

12. A method comprising:

collecting, by a sensor input circuit of a controller, a viscosity feedback signal from a viscosity sensor indicating a viscosity of a fluid and a dielectric feedback signal from a dielectric sensor indicating a dielectric constant of the fluid for a time interval;

collecting, by the sensor input circuit of the controller, a pressure signal from a pressure sensing assembly indicating a pressure differential drop across a filter element of a lubricant filtration system;

determining, by a service interval circuit of the controller, that at least one of the fluid or the filter element requires replacement based at least in part on the dielectric constant, the viscosity of the fluid, or the pressure differential;

responsive to determining that the filter element should be replaced, determining, by the service interval circuit, that the fluid should be replaced based on a remaining useful life of the fluid being less than a fluid expected useful life threshold, wherein the fluid expected useful life threshold is greater than a portion of an expected useful life of the fluid;

responsive to determining that the fluid should be replaced, determining, by the service interval circuit, that the filter should be replaced based on a remaining useful life of the filter being less than a filter expected useful life threshold, wherein the filter expected useful life threshold is greater than a portion of an expected useful life of the filter; and initiating, by the controller, a service alert to an operator device in response to determining that at least one of the fluid or the filter element require replacement.

13. The method of claim 12, wherein the fluid comprises a lubricant.

14. The method of claim 12, wherein the pressure sensing assembly comprises a differential pressure sensor, and wherein the pressure signal comprises a pressure differential feedback signal.

15. The method of claim 12, wherein the filter element requires replacement.

16. The method of claim 15, further comprising determining, by the service interval circuit of the controller, a remaining useful life of the fluid.

17. The method of claim 16, further comprising:

determining, by the service interval circuit of the controller, that the remaining useful life is below a threshold remaining useful life; and wherein initiating the service alert is in response to determining that both the fluid and the filter element require replacement.

18. The method of claim 12, wherein the fluid requires replacement.

19. The method of claim 18, determining, by the service interval circuit of the controller, a remaining useful life of the filter element.

20. The method of claim 19, further comprising:

determining, by the service interval circuit of the controller, that the remaining useful life is below a threshold remaining useful life; and wherein initiating the service alert is in response to determining that both the fluid and the filter element require replacement.

21. A controller for a fluid delivery system, comprising: a memory;

a processor configured to execute instructions stored in the memory;

a sensor input circuit configured to receive a pressure signal indicating a pressure drop across a filter element, a viscosity feedback signal indicating a viscosity index of a fluid, and a dielectric feedback signal indicating a dielectric constant of the fluid;

a service interval circuit configured to:

dynamically determine that at least one of the filter element should be replaced based at least in part on the pressure or the fluid should be replaced based at least in part on the viscosity feedback signal and the dielectric feedback signal;

responsive to determining that the filter element should be replaced, determine that the fluid should be replaced based on a remaining useful life of the fluid being less than a fluid expected useful life threshold, wherein the fluid expected useful life threshold is greater than a portion of an expected useful life of the fluid;

responsive to determining that the fluid should be replaced, determine that the filter should be replaced based on a remaining useful life of the filter being less than a filter expected useful life threshold, wherein the filter expected useful life threshold is greater than a portion of an expected useful life of the filter; and an operator input/output circuit configured to indicate to a user that at least one of the filter element and the fluid should be replaced in response to the service interval circuit determining that at least one of the filter element and the fluid should be replaced.

22. The controller of claim 21, wherein the operator input/output circuit is further configured to initiate a service alert to an operator device when at least one of the filter element or the fluid requires changing.

23. The controller of claim 22, wherein the operator input/output circuit is configured to initiate the service alert to the operator device when both the filter element and the fluid require changing.

24. The controller of claim 21, further comprising an engine control circuit structured to control the operation of an internal combustion engine coupled to the fluid delivery system.

25. The controller of claim 21, wherein the sensor input circuit is configured to receive a temperature signal indicative of a temperature of the fluid, and wherein the sensor interval circuit is structured to normalize the viscosity of the fluid based on the temperature of the fluid.

* * * * *